United States Patent [19]

Ziemba

[11] 4,015,531

[45] Apr. 5, 1977

[54] ELECTRICAL FUZE WITH SELECTABLE MODES OF OPERATION

[75] Inventor: Richard Thomas Ziemba, Burlington, Vt.

[73] Assignee: General Electric Company, Burlington, Vt.

[22] Filed: Jan. 31, 1975

[21] Appl. No.: 545,843

[52] U.S. Cl. ..... 102/70.2 R

[51] Int. Cl.[2] ..... F42C 11/06

[58] Field of Search ..... 102/70.2 R

[56] References Cited

UNITED STATES PATENTS

| | | | |
|---|---|---|---|
| 3,598,056 | 8/1971 | West | 102/70.2 |
| 3,703,145 | 11/1972 | Burkhardt | 102/70.2 |
| 3,714,898 | 2/1973 | Ziemba | 102/70.2 |
| 3,715,985 | 2/1973 | Fugelso | 102/70.2 |
| 3,734,021 | 5/1973 | McKenzie | 102/70.2 |
| 3,814,017 | 6/1974 | Backstein | 102/70.2 |
| 3,889,599 | 6/1975 | Apstein | 102/70.2 |

*Primary Examiner*—Verlin R. Pendegrass
*Attorney, Agent, or Firm*—Bailin L. Kuch

[57] ABSTRACT

A fuze for a round of ammunition is provided wherein the gun voltage used for initiating the primer is also used to contemporaneously charge the power supply capacitor.

16 Claims, 5 Drawing Figures

86
74
10
77
59
54
18
26
48
52
42
90
92
94
100
Firing Current (Amps)
0
1
2
3
4
5
6
Firing Time (Milliseconds)
50
100
150
200
250
300
350
400

ELECTRICAL FUZE WITH SELECTABLE MODES OF OPERATION

BACKGROUND OF THE INVENTION

1. Field of the Invention

This invention relates to electrically detonated fuzes for ammunition, particularly to a fuze which may be selected during firing by the gunner to operate in any one of a plurality of modes, e.g. superquick, delayed, or self destruct.

2. Prior Art

RC time fuzes, whose timing is varied by the charge on the capacitor are shown, for example, by G. Mountjoy in U.S. Pat. No. 3,502,024 issued Mar. 24, 1970, and the references cited therein. It is also known to charge the capacitor at the time of firing by an electrical conductor, magnetic induction or radio wave transmission, as shown by R. H. Pintell in U.S. Pat. No. 3,739,726 issued June 19, 1973.

None of these systems shows a convenient system for the gunner, particularly in an airplane utilizing a high rate of fire cannon, to adjust the mode of operation of the ammunition warhead fuze during firing. It is an object of this invention to provide such a system.

SUMMARY OF THE INVENTION

A feature of this invention is the use of the gun voltage for initiating the primer of a round of ammunition having a fuzed warhead to contemporaneously charge the power supply capacitor of the warhead fuze.

BRIEF DESCRIPTION OF THE INVENTION

These and other objects, features and advantages of this invention will be apparent from the following specification thereof taken in conjunction with the accompanying drawing in which.

DESCRIPTION OF THE INVENTION

Figure 1:
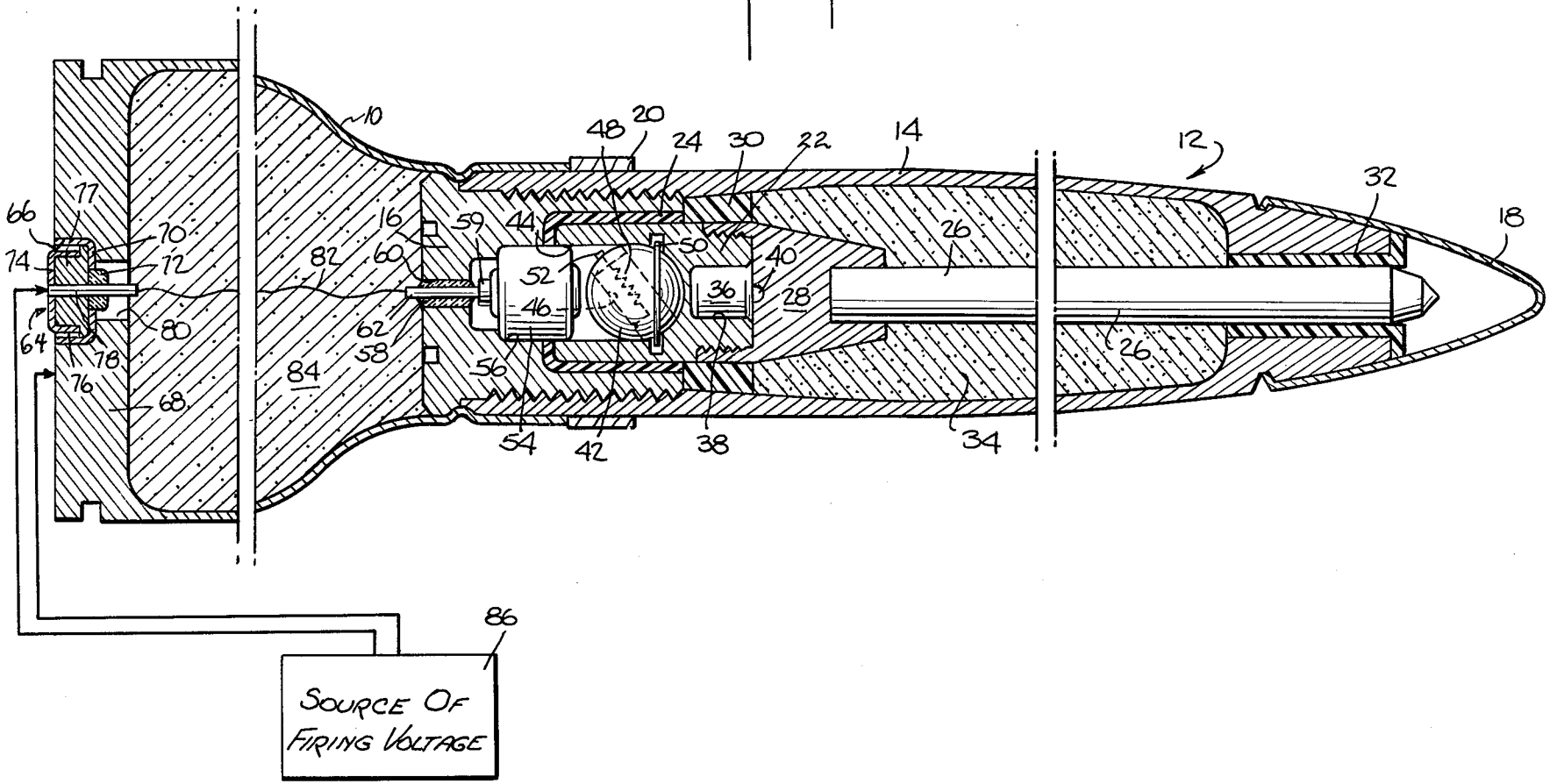
FIG. 1 shows a round of ammunition embodying a fuze of this invention.

The round of ammunition shown in FIG. 1 comprises a cartridge case 10 and a warhead 12 crimped therein. The warhead includes a metal shell 14, a metal base 16 threaded into the aft end of the shell 14, and a deformable metal windscreen 18 crimped onto the forward end of the shell. A rotating band 20 may also be fixed onto the shell. A fuze body 22 is fixed into an insulating cup 24 which is fixed into the base 16. A penetrator rod 26 has its aft end fitted into a metal support 28 which is threaded into the fuze body 22 and fitted into an insulating ring 30, and its forward end is fitted into an insulating ring 32 which is fixed into a bore in the forward end of the shell 14. The shell also encloses a quantity of high explosive powder 34. A booster charge 36 is captured in a recess 38 in the body 22 and communicates, upon detonation, through flash bores 40 with the explosive 34. A ball rotor 42, which may be of the type shown by me in U.S. Pat. No. 3,608,494, issued Sept. 28, 1971, is journalled in an aft bore 44 of the body 22. The ball rotor 42 has a diametrical bore 46 in which is fixed an electrical detonator 48. The ball is normally held in the safe, misaligned position, by a safing detent spring 50. Upon rotation of the warhead, the spring enlarges and the rotor precesses into alignment. The detonator 48 comprises a metal can having a glass bead closure at one end into which is mounted an electrical contact 52. A resistance wire is disposed within the can and is connected to and between the contact 52 and the can. The can is filled with detonating powder, and is electrically connected to the ball which is electrically connected to the body 22, which is electrically connected to the rod 26 via the support 28.

A cylindrical capacitor 54 is fixed into a bore 56 in the forward end of the base 16. A glass bead 58 is disposed in and seals a longitudinal bore 60 communicating with the bore 56. A longitudinal conductor 62 is fixed through the bead 58 and is in contact with a diode 59 which in turn is in contact with the aft center (positive) contact of the capacitor, whose side (negative) wall contact is in contact with the base 16. When the ball rotor is aligned, its contact 52 is in contact with the forward center (positive) contact of the capacitor.

An electrically actuated primer 64 is fixed in a bore 66 in the base 68 of the case 10. The primer comprises an outer metal cup 70 fixed into the bore 66, and having an insulator such as a glass bead 72 sealing a central hole in the cup. An inner metal cup 74 is fixed into and insulated from the outer cup by a suitable adhesive 76. Electrically conductive primer powder 77 is disposed in the volume enclosed between the cups. An electrical conductor 78 is fixed to the cup 74 and through the bead 72 and through a flash hole 80 into the internal volume of the case. A flexible conductor 82 is connected to and between the conductor 78 and the conductor 62. The internal volume of the cartridge case is filled with propellent powder 84.

It will be seen that a series electrical path is provided through the cup 74, the conductor 78, the wire 82, the conductor 62, the diode 59, the capacitor 54, the base 16, and the case 10. When firing voltage from a variable source 86 is applied to and between the cup 74 and the base 68, current flows from the cup 74, through the electrically conductive primer powder 77, to the cup 76 and then to the base 68. However, current concurrently flows in parallel from the cup 74 through the conductor 78, the wire 82, the conductor 62, the diode 59, the capacitor 54, the base 16 and then to the base 68.

The electrical characteristics of the primer are selected to require a significant increase in applied voltage to fire the case primer over and above that required to charge the fuze capacitor. The characteristics of a commercial electrical detonator, which approximate those desired, are shown in FIG. 4.

Figures 2, 3, 4, 5:
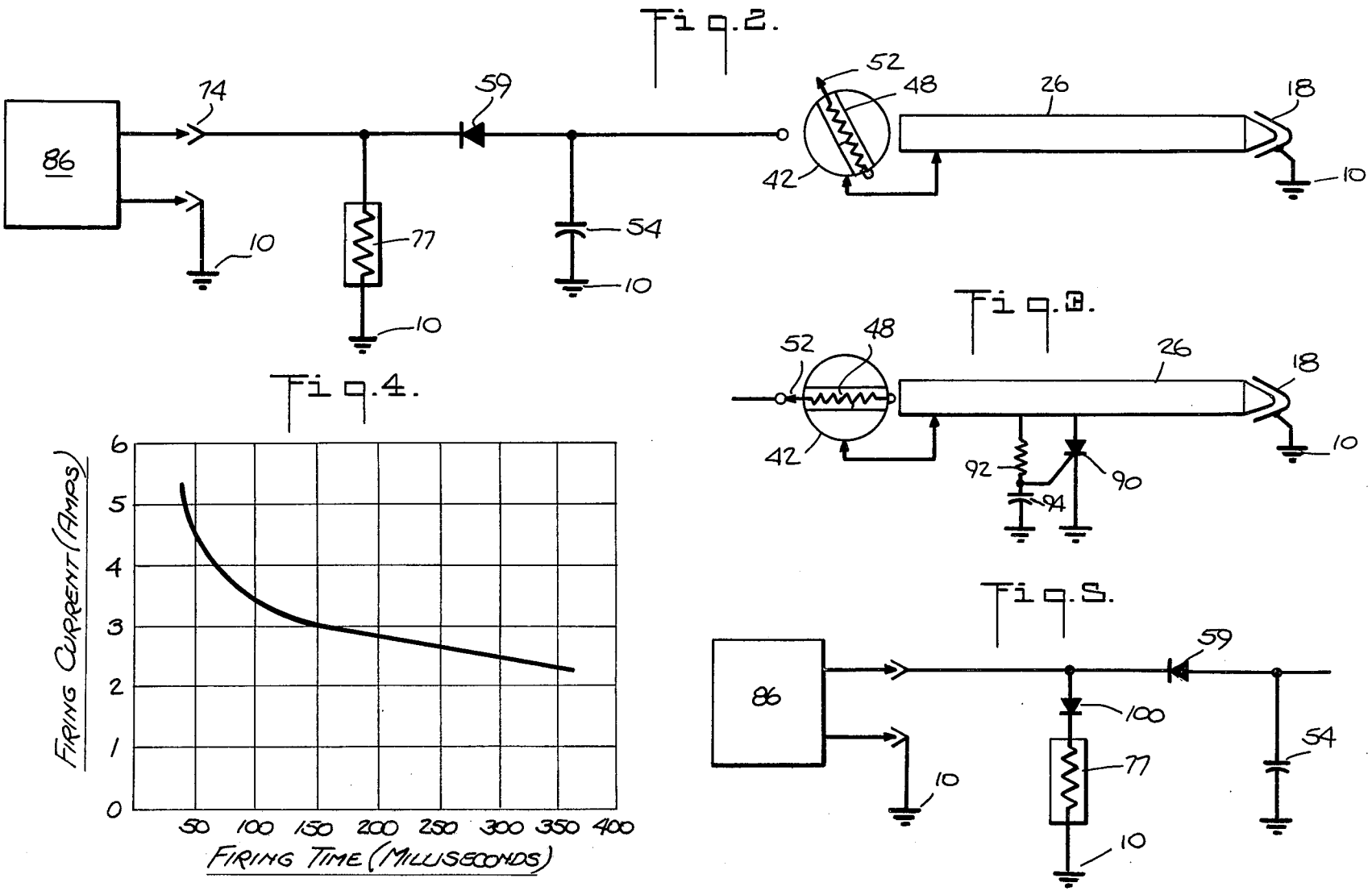
FIG. 2 shows an electrical schematic of the fuze of FIG. 1.
FIG. 3 shows an electrical schematic of a modification of the fuze of FIG. 2.
FIG. 4 shows the firing current vs response time of a detonator incorporated into the fuze of FIG. 1
FIG. 5 shows an electrical schematic of a second modification of the fuze of FIG. 2.

The essential structure of the fuze is shown in FIG. 2. The function of the diode 59 is to preclude discharge of the capacitor 54 in the event the primer becomes short-circuited after ignition thereof. After the projectile leaves the weapon, centrifugal force developed by the spin of the projectile causes the detent spring 50 to enlarge and to release the rotor 42, which in turn precesses to the aligned position (shown schematically in FIG. 3). Upon impact, the windscreen 18 contacts the rod 26 providing an electrical discharge circuit for the capacitor 54 through the detonator 48 to thereby initiate the warhead.

The response time of the fuze can be varied from "superquick" (≈10 μsec.) through "delayed" (≈500 μsec.) by varying the initial charge on the capacitor. The initial charge is determined by the length of time the firing voltage is applied and/or the level of that voltage, the resistance of the charging circuit and the capacitance of the capacitor. Alternatively, since it is energy content which initiates the primer, the voltage may be varied in amplitude, e.g. between 75 and 200 Vdc. At any voltage level selected, the capacitor would fully charge (to that level) before the primer would function.

A "self destruct" feature may be provided, as shown in FIG. 3, by providing an alternative path to ground for the capacitor in series with the detonator through a silicon controlled rectifier which is triggered by a RC delay in its gate circuit. The SCR 90 and its gate circuit, here shown as a resistance 92 and a capacitor 94, are conveniently located under the windscreen 18, as it is electrically in parallel with the windscreen/rod switch. The values of resistance 92 and capacitor 94 are chosen such that the SCR will fire when an adequate positive voltage is developed across the capacitor 94, and thereby at the gate of the SCR, at the desired self destruct time.

A third embodiment of the invention, by which selection of the firing mode may be accomplished, is shown in FIG. 5. An additional diode 100 is connected in series with the primer 77, with a polarity which is the reverse of that of the diode 59. With this arrangement of diodes, the primer will only function when the source of firing voltage is of polarity opposite to that required to charge the capacitor 54. In operation, a pulse of a first polarity and adequate voltage level to charge the capacitor 54 for the desired fuze function time is first applied, and then a pulse of the opposite polarity is applied to fire the primer. This arrangement avoids a "race" condition between the capacitor charging time and the primer firing time.

It will be appreciated that if the safety feature provided by the ball rotor is not required, the detonator 48 may be permanently connected in the circuit to capacitor 54.

What is claimed is:

1. A weapon system comprising:

a source of voltage having first and second output conductors;

a fuze for a round of ammunition, including first and second input conductors respectively and releasably coupled to said voltage source first and second conductors, an electrical primer coupled to and across said first and second input conductors, and requiring a first quantity of electrical power for ignition, a capacitor and unidirectional current flow controlling means coupled in series circuit to and across said first and second input conductors, said controlling means permitting charging of said capacitor from said first and second input conductors and precluding discharging of said capacitor through said first and second conductors, an electrical detonator and a normally open switch coupled in series circuit to and across said capacitor, said detonator requiring a second quantity of electrical power for ignition which is less than said first quantity of electrical power;

said weapon system having a mode of operation such that initially said input conductors are coupled to said voltage source conductors, said switch is open, and said capacitor receives and stores a third quantity of electrical power which is equal to or greater than said second quantity of electrical power before said primer receives and is ignited by said first quantity of electrical power, and subsequently said input conductors are decoupled from said voltage source conductors, said switch is closed, and said capacitor discharges stored electrical power to said detonator which ignites said detonator.

2. A weapon system according to claim 1 wherein: said switch comprises:

a normally open, voltage sensitive switching device; and timing means, operable a predetermined period of time after said ignition of said primer, for providing a voltage to said switching device adequate to cause said switching device to conduct.

3. A weapon system according to claim 1 wherein: said switch comprises:

a silicon controlled rectifier having a gate circuit, said rectifier connected in series circuit with said detonator;

a voltage time delay circuit coupled in parallel with said rectifier and having a voltage output terminal coupled to said gate circuit;

whereby said time delay circuit causes said rectifier to conduct after a predetermined period of time after said ignition of said primer.

4. A weapon system according to claim 3 wherein: said switch further comprises:

a normally open sub-switch which closes in response to a predetermined acceleration of said fuze, in series circuit with said rectifier and said time delay circuit which are coupled in parallel circuit.

5. A weapon system comprising:

a source of voltage having first and second output conductors for initially providing a first pulse of a first polarity and subsequently providing a second pulse of a second, opposite to said first pulse, polarity, both pulses being of substantially equal amplitude;

a fuze for a round of ammunition, including first and second input conductors respectively and releasably coupled to said voltage source first and second conductors, an electrical primer and first unidirectional current flow controlling means coupled in series circuit to and across said first and second input conductors, said first controlling means precluding the conduction of said first pulse and permitting the conduction of said second pulse through said primer, a capacitor and second unidirectional current flow controlling means coupled in series circuit to and across said first and second input conductors, said second controlling means precluding the conduction of said second pulse and permitting the conduction of said first pulse through said capacitor, an electrical detonator and a normally open switch coupled in series circuit to and across said capacitor, said weapon system having a mode of operation such that initially said input conductors are coupled to said voltage source conductors, said switch is open and said first pulse is provided and is conducted through and stored by said capacitor, and thereafter said second pulse is provided and is conducted through and ignites said primer, and subsequently said input conductors are decoupled from said voltage source conductors, said switch is closed, and said capacitor discharges stored electrical power to said detonator which ignites said detonator.

6. A weapon system according to claim 5 wherein: said switch comprises:

a normally open, voltage sensitive switching device; and timing means, operable a predetermined period of time after said ignition of said primer, for providing a voltage to said switching device adequate to cause said switching device to conduct.

7. A weapon system according to claim 5 wherein: said switch comprises:

a silicon controlled rectifier having a gate circuit, said rectifier connected in series circuit with said detonator;

a voltage time delay circuit coupled in parallel with said rectifier and having a voltage output terminal coupled to said gate circuit, whereby said time delay circuit causes said rectifier to conduct after a predetermined period of time after said ignition of said primer.

8. A weapon system according to claim 7 wherein: said switch further comprises:

a normally open sub-switch which closes in response to a predetermined acceleration of said fuze, in series circuit with said rectifier and said time delay circuit which are coupled in parallel circuit.

9. A fuze for a round of ammunition for a weapon 'stem having a source of voltage having first and sec- nd output conductors, comprising:

first and second input conductors adapted to be respectively and releasably coupled to the voltage source first and second conductors, an electrical primer coupled to and across said first and second input conductors, and requiring a first quantity of electrical power for ignition, a capacitor and unidirectional current flow controlling means coupled in series circuit to and across said first and second input conductors, said controlling means permitting charging of said capacitor from said first and second input conductors and precluding discharging of said capacitor through said first and second conductors, an electrical detonator and a normally open switch coupled in series circuit to and across said capacitor, said detonator requiring a second quantity of electrical power for ignition which is less than said first quantity of electrical power;

said fuze having a mode of operation such that initially said input conductors are coupled to said voltage source conductors, said switch is open, and said capacitor receives and stores a third quantity of electrical power which is equal to or greater than said second quantity of electrical power before said primer receives and is ignited by said first quantity of electrical power, and subsequently said input conductors are decoupled from said voltage source conductors, said switch is closed, and said capacitor discharges stored electrical power to said detonator which ignites said detonator.

10. A weapon system according to claim 9 wherein: said switch comprises:

a normally open, voltage sensitive switching device;

and timing means, operable a predetermined period of time after said ignition of said primer, for providing a voltage to said switching device adequate to cause said switching device to conduct.

11. A weapon system according to claim 9 wherein: said switch comprises:

a silicon controlled rectifier having a gate circuit, said rectifier connected in series circuit with said detonator:

a voltage time delay circuit coupled in parallel with said rectifier and having a voltage output terminal coupled to said gate circuit;

whereby said time delay circuit causes said rectifier to conduct after a predetermined period of time after said ignition of said primer.

12. A weapon system according to claim 11 wherein: said switch further comprises:

a normally open sub-switch which closes in response to a predetermined acceleration of said fuze, in series circuit with said rectifier and said time delay circuit which are coupled in parallel circuit.

13. A fuze for a round of ammunition for a weapon system having a source of voltage having first and second output conductors for initially providing a first pulse of a first polarity and subsequently providing a second pulse of a second, opposite to said first pulse, polarity, both pulses being of substantially equal amplitude, comprising:

an electrical primer and first unidirectional current flow controlling means coupled in series circuit to and across said first and second input conductors, said first controlling means precluding the conduction of said first pulse and permitting the conduction of said second pulse through said primer, a capacitor and second unidirectional current flow controlling means coupled in series circuit to and across said first and second input conductors, said second controlling means precluding the conduction of said second pulse and permitting the conduction of said first pulse through said capacitor, an electrical detonator and a normally open switch coupled in series to and across said capacitor, said weapon system having a mode of operation such that initially said input conductors are coupled to said voltage source conductors, said switch is open and said first pulse is provided and is conducted through and stored by said capacitor, and thereafter said second pulse is provided and is conducted through and ignites said primer, and subsequently said input conductors are decoupled from said voltage source conductors, said switch is closed, and said capacitor discharges stored electrical power to said detonator which ignites said detonator.

14. A weapon system according to claim 13 wherein:

said switch comprises:

a normally open, voltage sensitive switching device;

and timing means, operable a predetermined period of time after said ignition of said primer, for providing a voltage to said switching device adequate to cause said switching device to conduct.

15. A weapon system according to claim 13 wherein: said switch comprises:

a silicon controlled rectifier having a gate circuit, said rectifier connected in series circuit with said detonator;

a voltage time delay circuit coupled in parallel with said rectifier and having a voltage output terminal coupled to said gate circuit, whereby said time delay circuit causes said rectifier to conduct after a predetermined period of time after said ignition of said primer.

16. A weapon system according to claim 15 wherein: said switch further comprises:

a normally open sub-switch which closes in response to a predetermined acceleration of said fuze, in series circuit with said rectifier and said time delay circuit which are coupled in parallel circuit.

* * * * *